US010021769B2

(12) United States Patent
Ozaki et al.

(10) Patent No.: US 10,021,769 B2
(45) Date of Patent: Jul. 10, 2018

(54) LIGHT DRIVING APPARATUS AND LIGHT CONTROL SYSTEM

(71) Applicant: PANASONIC INTELLECTUAL PROPERTY MANAGEMENT CO., LTD., Osaka (JP)

(72) Inventors: Hajime Ozaki, Kyoto (JP); Tatsumi Setomoto, Osaka (JP); Tamotsu Ando, Osaka (JP); Tomokazu Yamamoto, Osaka (JP); Kazuhiro Matsumoto, Osaka (JP); Yusuke Tajima, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/596,353

(22) Filed: May 16, 2017

(65) Prior Publication Data

US 2017/0339772 A1 Nov. 23, 2017

(30) Foreign Application Priority Data

May 20, 2016 (JP) ..... 2016-101966

(51) Int. Cl.
*H05B 37/02* (2006.01)
*H05B 33/08* (2006.01)
*F21V 15/01* (2006.01)

(52) U.S. Cl.
CPC ..... *H05B 37/0272* (2013.01); *F21V 15/01* (2013.01); *H05B 33/0842* (2013.01)

(58) Field of Classification Search
CPC ..... F21V 15/01; F21V 23/00; F21V 23/023; F21V 23/026; F21V 23/045;
(Continued)

(56) References Cited

U.S. PATENT DOCUMENTS

2004/0200632 A1* 10/2004 Kanai ..... G03G 21/1619 174/385
2012/0268343 A1* 10/2012 Yanagi ..... H01Q 1/526 343/872
(Continued)

FOREIGN PATENT DOCUMENTS

JP 2015-037042 2/2015

*Primary Examiner* — Tung X Le
*Assistant Examiner* — Henry Luong
(74) *Attorney, Agent, or Firm* — Greenblum & Bernstein, P.L.C.

(57) ABSTRACT

A light driving apparatus which supplies power to a light source in accordance with an indication from a control apparatus includes: a housing which is box-shaped; a wireless communication module which is housed in the housing, and includes an antenna for wireless communication with the control apparatus; and a light driver which is housed in the housing, and supplies power to the light source in accordance with the indication received from the control apparatus via the wireless communication module, wherein the housing includes two opposite faces having slits through which an electromagnetic wave which the antenna emits when excited by the wireless communication module passes, the slits extending in a direction three-dimensionally crossing a direction in which the wireless communication module excites the antenna.

7 Claims, 11 Drawing Sheets

(58) Field of Classification Search
CPC . H05B 33/0842; H05B 37/0272; F21S 8/026; F21Y 2115/10; H01Q 13/18; H01Q 13/22; H01Q 9/20
See application file for complete search history.

(56) References Cited

U.S. PATENT DOCUMENTS

2016/0069551 A1* 3/2016 Ando ..... F21V 23/023
362/221
2016/0165702 A1* 6/2016 Lai ..... H05B 37/0272
315/201

* cited by examiner

LIGHT DRIVING APPARATUS AND LIGHT CONTROL SYSTEM

CROSS REFERENCE TO RELATED APPLICATION

This application claims the benefit of priority of Japanese Patent Application Number 2016-101966 filed on May 20, 2016, the entire content of which is hereby incorporated by reference.

BACKGROUND

1. Technical Field

The present disclosure relates to a light driving apparatus and a light control system, and in particular to a light driving apparatus which includes a wireless communication module, for instance.

2. Description of the Related Art

A lighting device which supplies power to a light source in accordance with an indication from a control apparatus has been proposed (for example, see Japanese Unexamined Patent Application. Publication No. 2015-37042).

The lighting device disclosed in Japanese Unexamined Patent Application Publication No. 2015-37042 secures a satisfactory transmission and reception function for wireless communication by providing an antenna outside the power supply module covered with a metal housing.

SUMMARY

However, the lighting device disclosed in Patent Literature 1 needs to cover the antenna provided outside the power supply module with a resin housing, and furthermore fix the antenna. This makes the structure of the lighting device complicated, and also complicates the work for installing the lighting device in a building.

Here, it is conceivable to house the antenna in the metal housing in order to simplify the structure of the lighting device, yet electromagnetic waves emitted by the antenna and electromagnetic waves which are to come in from the outside are blocked by the metal housing in such a case. This results in a difficulty in securing a satisfactory transmission and reception function for wireless communication.

In view of this, the present disclosure provides a light driving apparatus and a light control system which can secure a satisfactory transmission and reception function for wireless communication without having a complicated structure.

In order to provide such an apparatus, a light driving apparatus according to an aspect of the present disclosure is a light driving apparatus which supplies power to a light source in accordance with an indication from a control apparatus, the light driving apparatus including: a housing which is box-shaped; a wireless communication module which is housed in the housing, and includes an antenna for wireless communication with the control apparatus; and a light driver which is housed in the housing, and supplies power to the light source in accordance with the indication received from the control apparatus via the wireless communication module, wherein the housing includes two opposite faces having slits through which an electromagnetic wave which the antenna emits when excited by the wireless communication module passes, the slits extending in a direction three-dimensionally crossing a direction in which the wireless communication module excites the antenna.

Furthermore, in order to provide such a system, a light control system according to an aspect of the present disclosure includes; a plurality of light driving apparatuses each being the light driving apparatus; and a control apparatus which wirelessly transmits indications to the plurality of light driving apparatuses.

The present disclosure provides a light driving apparatus and a light control system which can sufficiently secure a transmission and reception function for wireless communication without having a complicated structure.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

The following describes embodiments of the present disclosure in detail, with reference to the drawings. The embodiments described below each show a specific example. The numerical values, shapes, materials, elements, the arrangement and connection of the elements, results of simulations and actual measurement, and others indicated in the following embodiments are mere examples, and are not intended to limit the present disclosure. Therefore, among the elements in the following embodiments, elements not recited in any of the independent claims defining the most generic part of the inventive concept of the present disclosure are described as optional elements.

Figure 1:
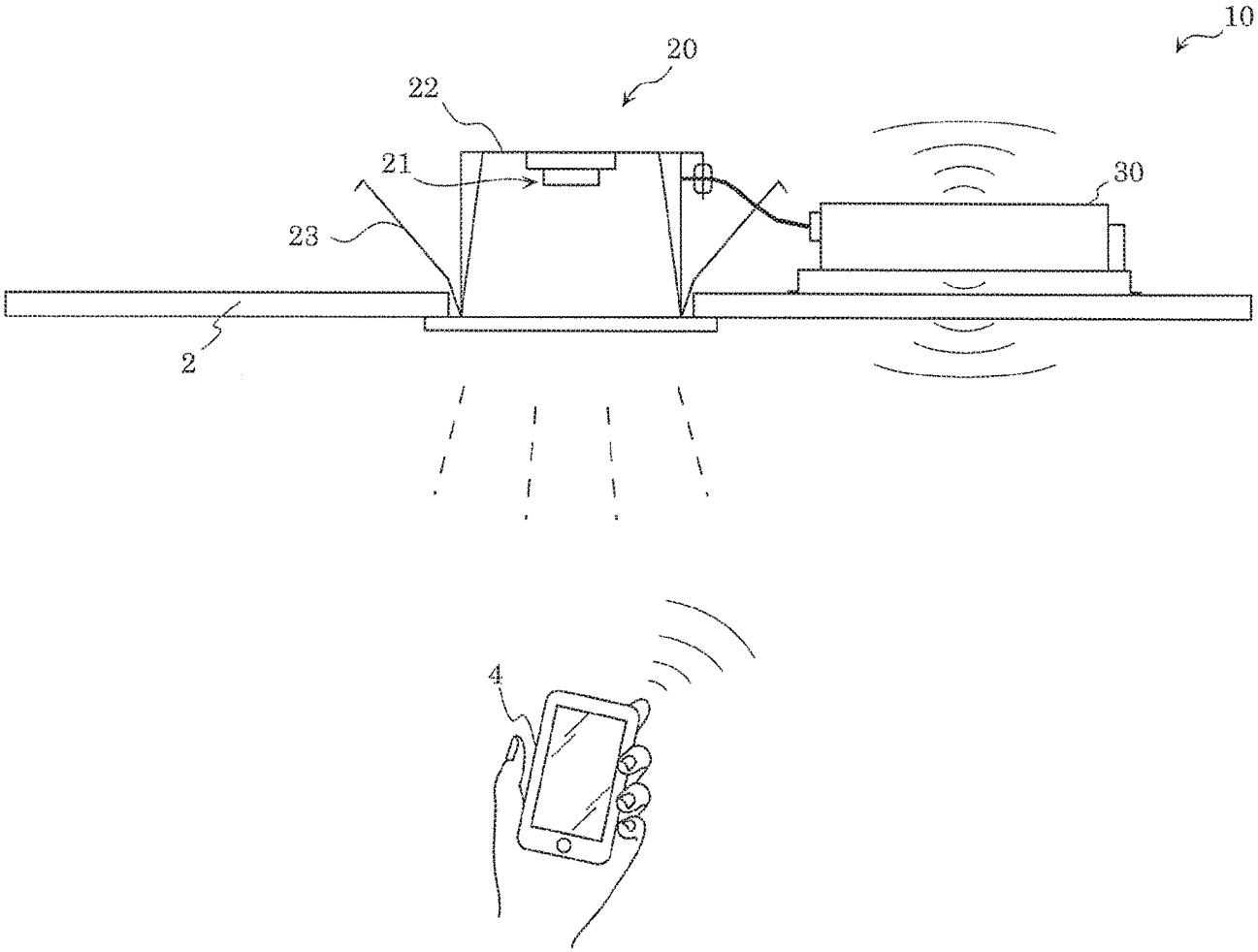
FIG. 1 is a schematic cross-sectional view of a lighting device according to an embodiment.

FIG. 1 is a schematic cross-sectional view of lighting device 10 according to an embodiment. Here, FIG. 1 illustrates the state where lighting device 10 which is a downlight is disposed in ceiling 2. FIG. 1 also illustrates control apparatus 4 which controls lighting device 10 through wireless communication.

In the present embodiment, lighting device 10 is a downlight, and includes light 20 and light driving apparatus 30.

Light 20 is fixed in coiling 2, and includes light source 21 which includes, for instance, a light emitting diode (LED), case 22 which, covers light source 21, and flat springs 23 which prevent case 22 from falling.

Light driving apparatus 30 is a power supply module which supplies power to light source 21 in accordance with an indication from control apparatus 4, and is electrically connected with a grid power supply and light 20 (more specifically, light source 21 of light 20).

Control apparatus 4 controls lighting device 10 through wireless communication, and is, for example, a personal digital assistant such as a smartphone which transmits a command through wireless communication to lighting device 10 while an application is being executed.

Figure 2:
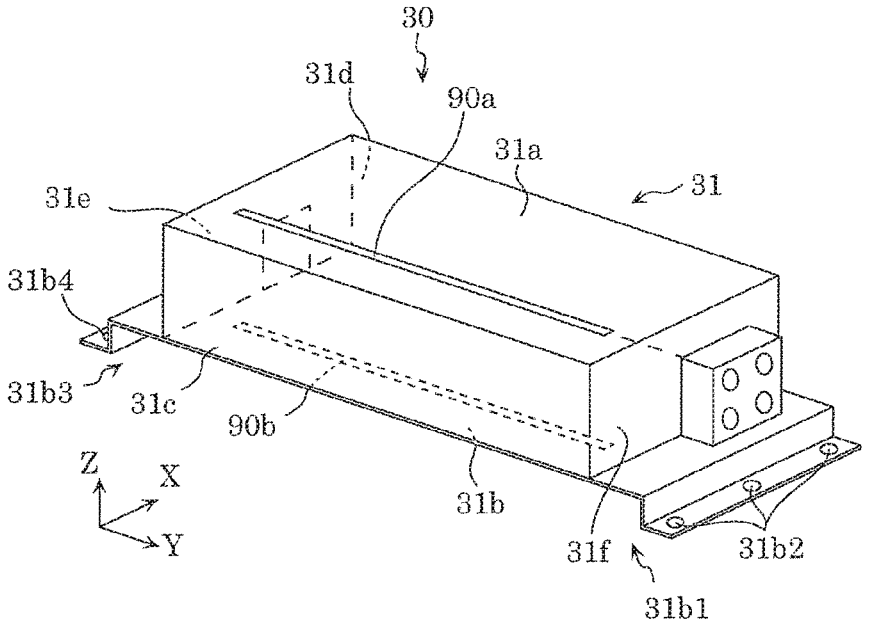
FIG. 2 is an appearance perspective view of a light driving apparatus illustrated in FIG. 1.

FIG. 2 is an appearance perspective view of light driving apparatus 30 illustrated in FIG. 1. Note that the X axis, the Y axis, and the Z axis which indicate three orthogonal directions are also illustrated in FIG. 2 (in the other diagrams as well). Note that in the following description, "along the X (Y or Z) axis" indicate both the positive and negative directions of the X (Y or Z) axis, whereas a "direction" indicates only one of the positive and negative directions of the X (Y or Z) axis.

Light driving apparatus 30 includes box-shaped housing 31 (in other words, housing 31 having a rectangular parallelepiped shape) defined by six faces (top face 31*a*, bottom face 31*b*, and four lateral faces 31*c* to 31*f*). Housing 31 is a metal (for example, aluminum) case for housing a circuit component inside, and the size of housing 31 is defined by, for example, a height (length along the Z axis) of about 5 cm, a width (length along the Y axis) of about 18 cm, and the depth (length along the X axis) of about 8 cm. Top face 31*a*, bottom face 31*b*, and two lateral faces 31*c* and 31*d* have an elongated shape extending in the Y axis direction. Bent portions 31*b*1 and 31*b*3 having, respectively, screw holes 31*b*2 and 31*b*4 for fixing light driving apparatus 30 to ceiling 2 are provided at the ends of the length (the Y axis direction) of bottom face 31*b*.

Here, a distinctive point is that top face 31*a* and bottom face 31*b* of housing 31 have slits 90*a* and 90*b* for passing electromagnetic waves, which are extending lengthwise (along the axis) of top face 31*a* and bottom face 31*b*, respectively. Slits 90*a* and 90*b* are openings defined by closed contours and formed in top face 31*a* and bottom, face 31*b* of housing 31 (specifically, through holes cut out), and have a length which is substantially a half wave length of a frequency for wireless communication which light driving apparatus 30 uses. In the present embodiment, the frequency for wireless communication which light driving apparatus 30 uses is in the 920 MHz band, and slits 90*a* and 90*b* have an oblong shape (a rectangle or an oblong shape having two curved edges) having a length of 145 to 175 mm and a width of 0.1 to 5 mm.

Figure 3:
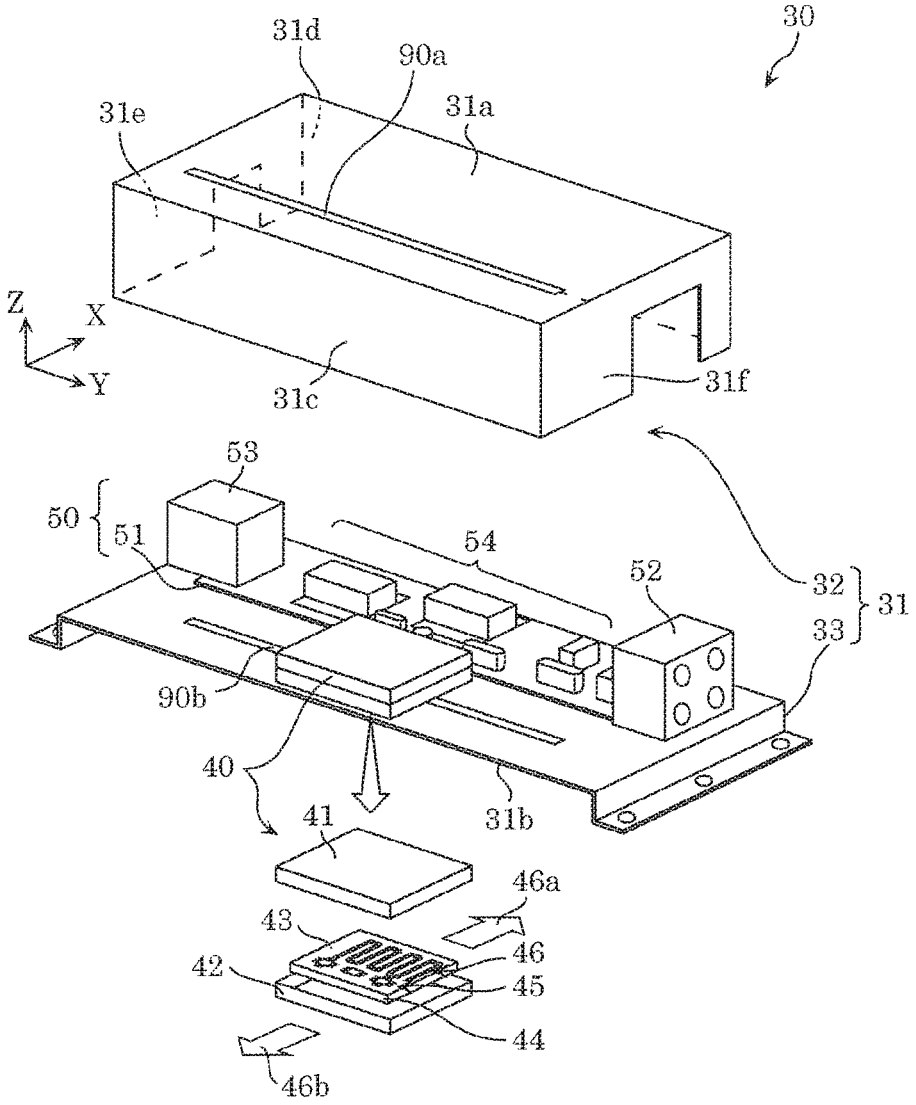
FIG. 3 is an exploded perspective view of the light driving apparatus illustrated in FIG. 2.

FIG. 3 is an exploded perspective view of light driving apparatus 30 illustrated in FIG. 2.

Light driving apparatus 30 includes housing 31, wireless communication module 40, and light driver 50.

Housing 31 includes bottom housing 33, and cover housing 32 which covers bottom housing 33. Bottom housing 33 corresponds to bottom face 31*b* of housing 31. Cover housing 32 includes five faces (top face 31*a* and four lateral faces 31*c* to 31*f*) of housing 31. Bottom housing 33 and cover housing 32 are engaged or screwed to be joined.

Wireless communication module 40 is housed in housing 31, and includes an antenna for wireless communication with control apparatus 4. Wireless communication module 40 includes upper cover 41, lower cover 42, and circuit board 43 as illustrated in FIG. 3. Upper cover 41 and lower cover 42 engage with each other to form an insulating housing for housing circuit board 43, and is a resin cover, for example. Circuit board 43 is disposed parallel to bottom face 31*b* of housing 31, and includes substrate 44, circuit component 45 mounted on substrate 44, and antenna 46 which includes a wiring pattern formed on substrate 44. Antenna 46 is formed in the XY plane in the present embodiment, in a zigzag wiring pattern, whose length along the X axis is long and length along the Y axis is short. In wireless communication, antenna 46 is excited in the X axis directions.

Light driver 50 is a circuit module which is housed in housing 31, and supplies power to light source 21 of light 20 in accordance with an indication received from control apparatus 4 via wireless communication module 40. Light driver 50 includes substrate 51 having an elongated shape (rectangular shape) extending along the Y axis, and also grid power connector 52, light connector 53, and circuit components 54 which are mounted on substrate 51, as illustrated in FIG. 3.

Figure 4:
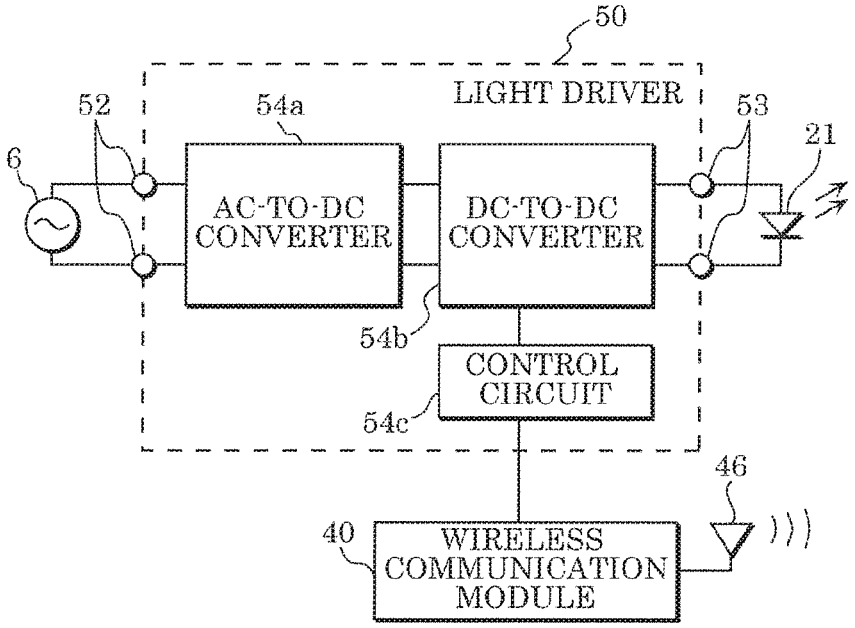
FIG. 4 is a block diagram of a light driver illustrated in FIG. 3.

FIG. 4 is a block diagram of light driver 50 illustrated in FIG. 3.

Light driver 50 includes grid power connector 52, circuit components 54 (AC-to-DC converter 54*a*, DC-to-DC converter 54*b*, control circuit 54*c*), and light connector 53.

Grid power connector 52 is a connector to which a power cable for supplying alternating current (ac) power from grid power supply 6 is connected. AC-to-DC converter 54*a* is a rectifier and smoothing circuit which converts ac power supplied via grid power connector 52 into direct current (dc) power. DC-to-DC converter 54*b* is a power supply circuit which converts a direct voltage output from AC-to-DC converter 54*a* into a direct voltage suitable for passing constant current through light source 21 via light connector 53, and is a switching DC-to-DC converter, for example, Control circuit 54*c* controls DC-to-DC converter 54*b* in accordance with an indication transmitted from wireless communication module 40, and controls the magnitude of current (dimming) which DC-to-DC converter 54*b* supplies to light source 21, for example. Light connector 53 is a connector for connecting a cable for supplying current to light source 21 of light 20.

Referring back to FIG. 3, a description of a distinctive structure of light driving apparatus 30 illustrated in FIG. 3 is given.

Slits 90*a* and 90*b* are extending, respectively, in top face 31*a* and bottom face 31*b* of housing 31 in a direction (here, along the Y axis) three-dimensionally crossing the directions 46*a* and 46*b* (X axis directions) in which wireless communication module 40 excites antenna 46. Moreover, top face 31*a* and bottom face 31*b* of housing 31 which have slits 90*a* and 90*b*, respectively, are opposed to substrate 44 on which a wiring pattern serving as antenna 46 is formed. Accordingly, slits 90*a* and 90*b* are provided in a direction in which electromagnetic waves are emitted from antenna 46. Thus, electromagnetic waves are emitted from antenna 46 at a high gain, and electromagnetic waves from the outside efficiently fall on antenna 46.

Note that the direction crossing the direction in which antenna 46 is excited is not limited to only the direction orthogonal to the excitation direction, but also a direction substantially orthogonal to the excitation direction (for example, the direction crossing the excitation direction at an acute angle of 70 degrees or more).

Slits 90*a* and 90*b* are extending lengthwise (along the Y axis) in top face 31*a* and bottom face 31*b* of housing 31 respectively. Thus, slits 90*a* and 90*b* having a length suitable for a frequency for wireless communication are firmed extending lengthwise, and thus the size of housing 31 is reduced while a gain in transmission and reception through wireless communication is sufficiently secured.

Slits 90*a* and 90*b* are formed in top face 31*a* and bottom face 31*b*, rather than lateral faces of housing 31. Accordingly, providing slits 90*a* and 90*b* in lateral faces of housing 31 which are likely to have a low structural strength is avoided. This avoids a problem that the force of a hand holding housing 31 deforms the lateral faces of housing 31 when housing 31 is manufactured or moved.

Wireless communication module 40 and light driver 50 are disposed widthwise (along the X axis) of the elongated shape, side by side on bottom face 31*b* inside housing 31. When viewed perpendicularly to top face 31*a* and bottom face 31*b* (in the Z axis direction), slits 90*a* and 90*b* are extending in top face 31*a* and bottom face 31*b*, respectively, on the wireless communication module 40 side (in the negative direction of the X axis) relative to the center line which halves the width of top face 31*a* and the width of bottom face 31*b* (the center line along the Y axis). Accordingly, when housing 31 is viewed from above, slits 90*a* and 90*b* are formed, extending along the Y axis on a side where wireless communication module 40 is disposed (in the negative direction of the X axis), among wireless communication module 40 and light driver 50 disposed side by side, widthwise of housing 31 (X axis direction). Therefore, even if light driving apparatus 30 is installed in such a manner that light driver 50 heavier than wireless communication module 40 is accidentally placed in a lower position, and wireless communication module 40 is positioned in a higher position (lateral face 31*d* is the horizontal face (bottom face) close to the ground), the following is secured. In other words, slits 90*a* and 90*b* will be placed in a higher position of housing 31, which thus secures heat dissipation of light driving apparatus 30 due to chimney effect (in other words, slits 90*a* and 90*b* serving as heat dissipation openings).

When viewed perpendicularly (in the Z axis direction) to top face 31*a* and bottom face 31*b* of housing 31, slits 90*a* and 90*b* overlap wireless communication module 40. Accordingly, slits 90*a* and 90*b* are formed on the wireless communication module 40 side than on the light driver 50 side, and thus electromagnetic waves are efficiently emitted from antenna 46, and electromagnetic waves from the outside efficiently fall on antenna 46. Furthermore, the chimney effect mentioned above allows efficient heat dissipation.

When viewed perpendicularly to top face 31*a* and bottom face 31*b* of housing 31 (in the Z axis direction), slits 90*a* and 90*b* overlap each other. Accordingly, electromagnetic waves symmetrically emitted from antenna 46 efficiently pass through slits 90*a* and 90*b*, and electromagnetic waves from the outside efficiently fall on antenna 46.

Slits 90*a* and 90*b* are openings defined by closed contours in top face 31*a* and bottom face 31*b* of housing 31, respectively. Accordingly, housing 31 functions as a slit antenna, and thus a satisfactory transmission and reception function of wireless communication is secured without employing a complicated structure.

The following describes a property of emitting electromagnetic waves of light driving apparatus 30 according to the present embodiment which has the above configuration, using results obtained by simulations.

Figure 5A:
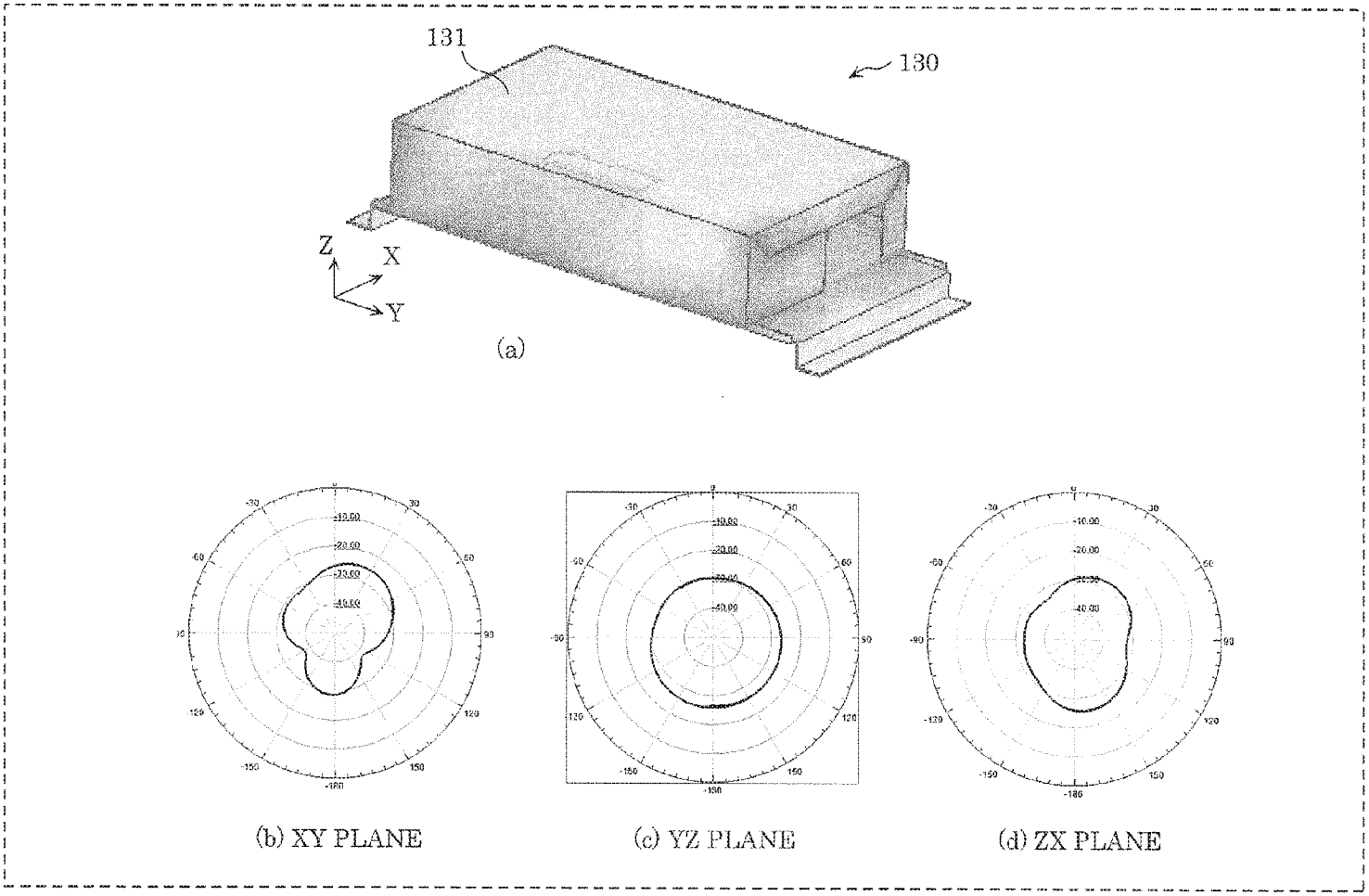
FIG. 5A is a diagram illustrating a property of emitting electromagnetic waves that a light driving apparatus according to a comparative example has.

FIG. 5A is a diagram illustrating a property of emitting electromagnetic waves of light driving apparatus 130 according to a comparative example in which housing 131 has no slits. Specifically, (a) of FIG. 5A illustrates a current distribution over housing 131 when light driving apparatus 130 is emitting electromagnetic waves. Parts (b), (c), and (d) of FIG. 5A illustrate patterns of emission of electromagnetic waves in the XY plane, the YZ plane, and ZX plane, respectively.

Figure 5B:
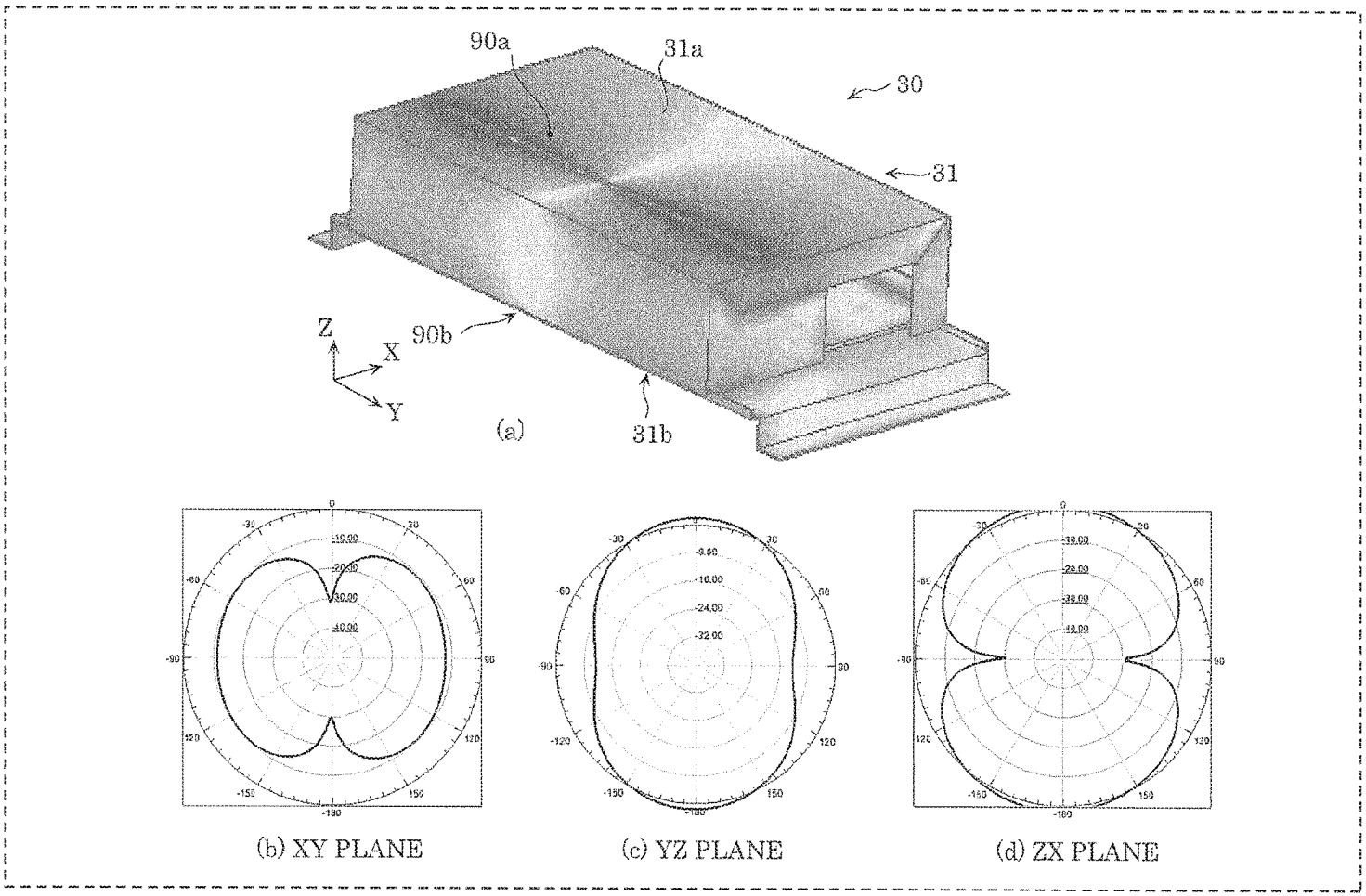
FIG. 5B is a diagram illustrating a property of emitting electromagnetic waves that the light driving apparatus according to the embodiment has.

FIG. 5B is a diagram illustrating a property of emitting electromagnetic waves of light driving apparatus 30 according to the present embodiment in which slits 90*a* and 90*b* are formed in top face 31*a* and bottom face 31*b* of housing 31, respectively. Specifically, (a) of FIG. 5B illustrates a current distribution over housing 31 when light driving apparatus 30 is emitting electromagnetic waves. Parts (b), (c), and (d) of FIG. 5B illustrate patterns of emission of electromagnetic waves (directional gains) in the XY plane, the YZ plane, and the ZX plane, respectively.

Note that the current distributions illustrated in (a) of FIG. 5A and (a) of FIG. 5B show that the darker a portion is, the greater current is flowing through the portion. The emission patterns illustrated in (b) to (d) of FIG. 5A and (b) to (d) of FIG. 5B show a directional gain (dBi) in the planes with respect to a perfect nondirectional antenna (isotropic antenna).

As is clear from the comparison between (a) of FIG. 5A and (a) of FIG. 5B, light driving apparatus 30 according to the present embodiment obtains a current distribution as if slits 90*a* and 90*b* were functioning as half wavelength dipole antennas. Stated differently, in light driving apparatus 30 according to the present embodiment, a great current is flowing through housing 31 about slits 90*a* and 90*b*, which shows that housing 31 is functioning as a slit antenna.

As is clear from the comparisons between (b) to (d) of FIG. 5A and (b) to (d) of FIG. 5B, the directional gains of light driving apparatus 30 according to the present embodiment are higher in all the XY plane, the YZ plane, and the ZX plane than those of light driving apparatus 130 according to the comparative example. Specifically, in all the XY plane, the YZ plane, and the ZX plane, the directional gains of light driving apparatus 130 according to the comparative example are about −29 dBi, whereas the directional gains of light driving apparatus 30 according to the present embodiment are about −8 dBi, which shows an improvement of about 21 dB.

As described above, in light driving apparatus 30 according to the present embodiment, wireless communication module 40 is housed in housing 31, and slits 90*a* and 90*b* through which electromagnetic waves emitted from antenna 46 efficiently pass are formed in two opposite faces of housing 31. Thus, wireless communication can be satisfactorily performed without providing antenna 46 of wireless communication module 40 outside housing 31. In other words, light driving apparatus 30 which can secure a satisfactory transmission and reception function of wireless communication is achieved without employing a complicated structure.

Note that slits 90*a* and 90*b* are provided in top face 31*a* and bottom face 31*b* of housing 31 in light driving apparatus 30 according to the present embodiment, yet slits 90*a* and 90*b* may be provided in other two opposite faces of housing 31.

Figure 6:
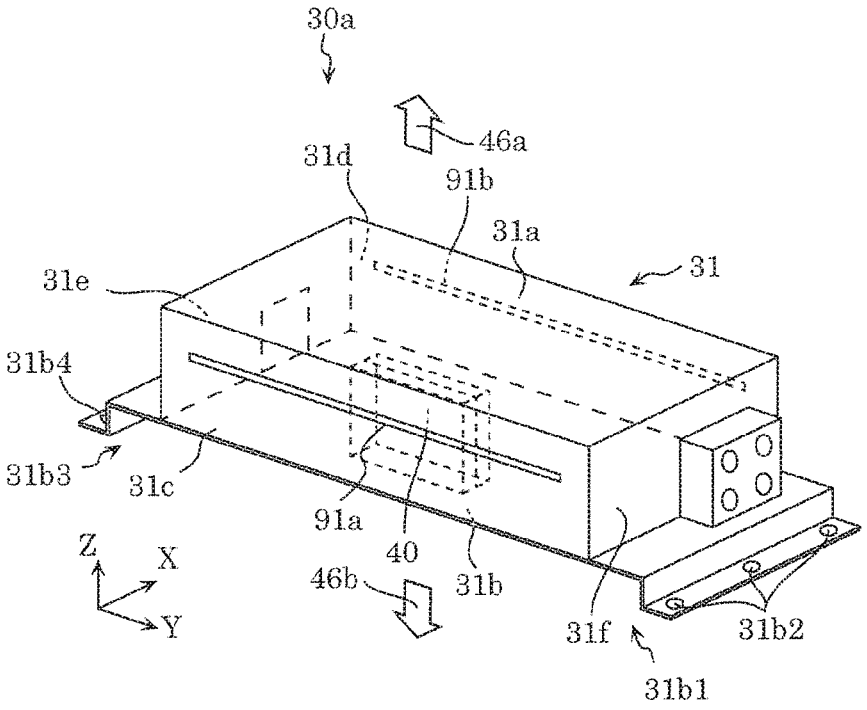
FIG. 6 is an appearance perspective view of a light driving apparatus according to a variation of the embodiment.

FIG. 6 is an appearance perspective view of light driving apparatus 30*a* according to a variation of the above embodiment. In light driving apparatus 30*a*, slits 91*a* and 91*b* are formed, extending lengthwise of two lateral faces 31*c* and 31*d* of housing 31 (along the Y axis).

Note that in light driving apparatus 30*a* having such a structure, wireless communication module 40 (more precisely, substrate 44 inside wireless communication module 40) is fixed perpendicularly to bottom face 31*b* of housing 31, as illustrated in FIG. 6. Thus, in this variation, antenna 46 housed in wireless communication module 40 is formed in the YZ plane, in a zigzag wiring pattern whose length along the Z axis is long and length along the Y axis is short. The direction in which antenna 46 is excited in wireless communication is the Z axis direction. Thus, also in this variation, slits 91*a* and 91*b* in lateral faces 31*c* and 31*d* of housing 31 extend in a direction (here, along the Y axis) three-dimensionally crossing the direction (Z axis directions) in which wireless communication module 40 excites antenna 46. Moreover, slits 91*a* and 91*b* are extending parallel to substrate 44 on which a wiring pattern serving as antenna 46 is formed.

In this manner, similarly to the above embodiment, slits 90*a* and 90*b* are provided in the direction in which electromagnetic waves are emitted from antenna 46, and thus electromagnetic waves are emitted from antenna 46 at a high gain, and electromagnetic waves from the outside efficiently fall on antenna 46.

Figure 7:
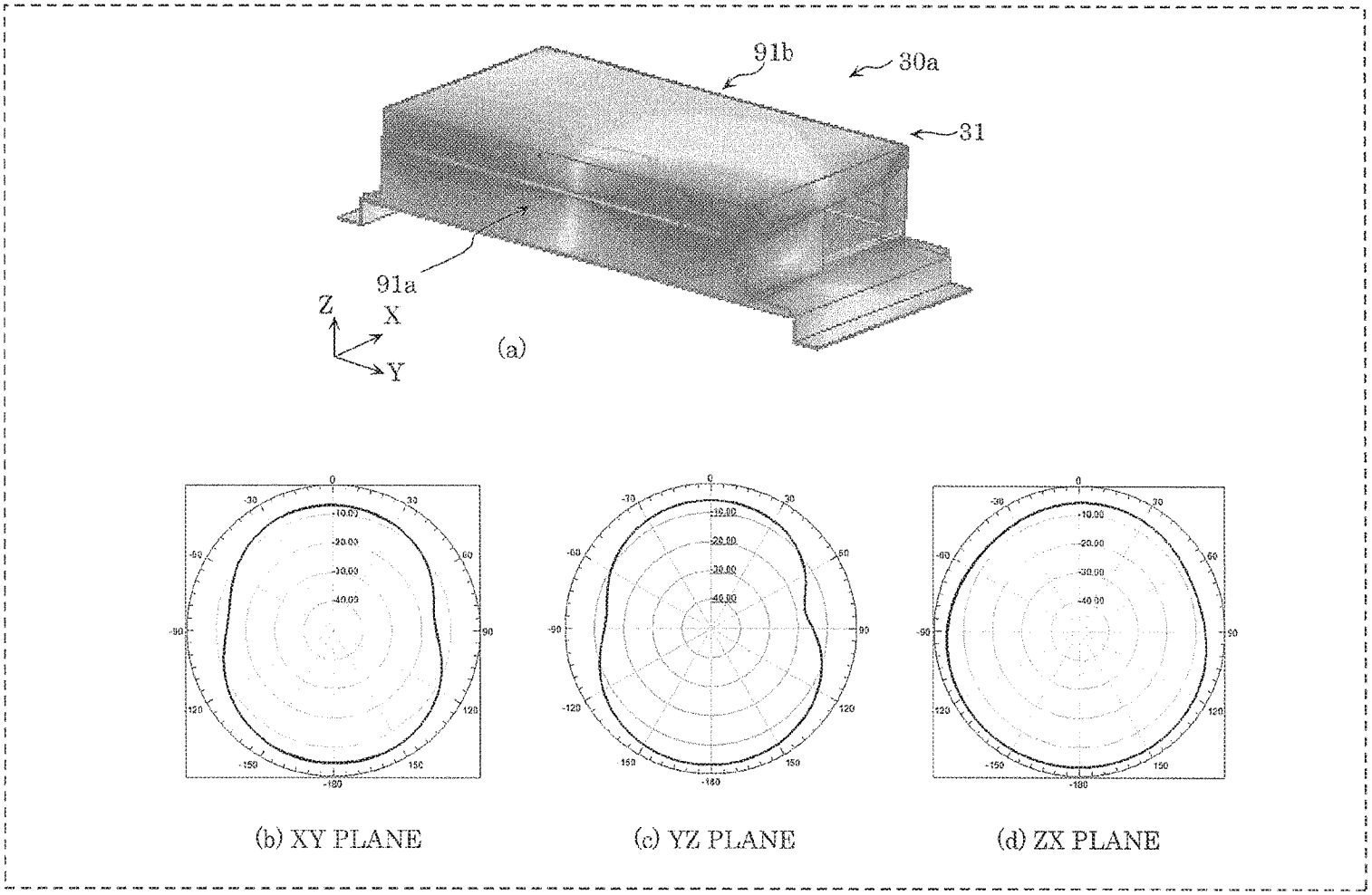
FIG. 7 is a diagram illustrating a property of emitting electromagnetic waves that the light driving apparatus illustrated in FIG. 6 has.

FIG. 7 is a diagram illustrating a property of emitting electromagnetic waves of light driving apparatus 30*a* according to this variation. FIG. 7 is a diagram corresponding to FIG. 5B in the above embodiment. Specifically, (a) of FIG. 7 illustrates a current distribution over housing 31 when light driving apparatus 30*a* is emitting electromagnetic waves. Parts (b), (c), and (d) of FIG. 7 illustrate patterns (directional gains) of emission of electromagnetic waves in the XY plane, the YZ face, and the ZX plane, respectively.

As is clear from the comparison between (a) of FIG. 7 and (a) of FIG. 5A according to the comparative example, also in light driving apparatus 30*a* according to this variation, great current is flowing through housing 31 about slits 91*a* and 91*b*, and housing 31 is functioning as a slit antenna.

As is clear from the comparisons between (b) to (d) of FIG. 7 and (b) to (d) of FIG. 5A according to the comparative example, the directional gains of light driving apparatus 30*a* according to this variation are higher in all the XY plane, the YZ face, and the ZX plane than those of light driving apparatus 130 according to the comparative example. Specifically, in all the XY plane, the YZ plane, and the ZX plane, the directional gains of light driving apparatus 30*a* according to this variation are about −9 dBi, which shows an improvement of about 20 dB.

As described above, in light driving apparatus 30*a* according to this variation, wireless communication module 40 is housed in housing 31, and slits 91*a* and 91*b* through which electromagnetic waves emitted from antenna 46 efficiently pass are formed in two opposite faces of housing 31. Thus, wireless communication can be satisfactorily performed without providing antenna 46 of wireless communication module 40 outside housing 31 in other words, light driving apparatus 30*a* which can secure a satisfactory transmission and reception function of wireless communication is achieved without employing a complicated structure.

Note that the strength of electromagnetic waves emitted through the slits is influenced according to the positional relation between the wireless communication module and the slits provided in the housing of the light driving apparatus, and thus results obtained by simulations and actual measurements are shown as reference data for such relations.

Here, the following six relations (six measurement conditions) are employed each as the positional relation between the wireless communication module and the slits provided in the housing of light driving apparatus.

(1) Measurement Condition 1 (all Gaps are Sealed)

Measurement condition 1 corresponds to light driving apparatus 130 according to the above comparative example. Stated differently, under measurement condition 1, all the gaps in the housing of light driving apparatus are sealed with metal.

(2) Measurement Condition 2 (Parallel Slits are Only Openings)

Figure 8A:
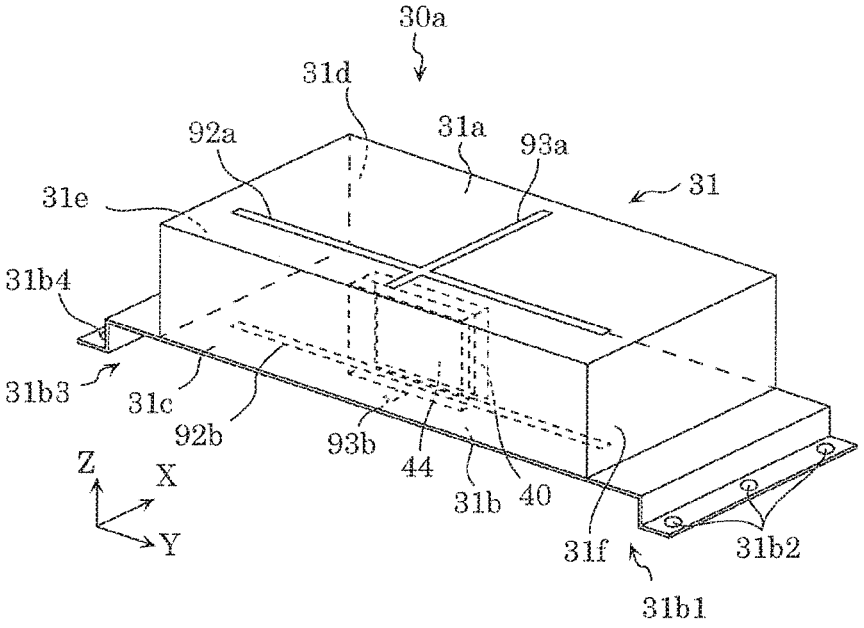
FIG. 8A is an external view of the light driving apparatus for describing measurement conditions 2 and 3.

Under measurement condition 2, only parallel slits 92*a* and 92*b* in top face 31*a* and bottom face 31*b* of the housing are provided as the openings which are provided in the housing of light driving apparatus, as illustrated in FIG. 8A. Stated differently, under measurement condition 2, only parallel slits 92*a* and 92*b* are formed in top face 31*a* and bottom face 31*b* of the housing, extending being coplanar with substrate 44 in wireless communication module 40 (directly above and under substrate 44 and along the Y axis).

(3) Measurement Condition 3 (Vertical Slit is Only Opening)

Under measurement condition 3, only vertical slits 93*a* and 93*b* in top face 31*a* and bottom face 31*b* of the housing are provided as the openings which are provided in the housing of the light driving apparatus, as illustrated in FIG. 8A. Stated differently, under measurement condition 3, only vertical slits 93*a* and 93*b* are formed in top face 31*a* and bottom face 31*b* of the housing, perpendicularly to substrate 44 in wireless communication module 40 (along the X axis).

(4) Measurement Condition 4 (Antenna is Exposed from Housing)

Figure 8B:
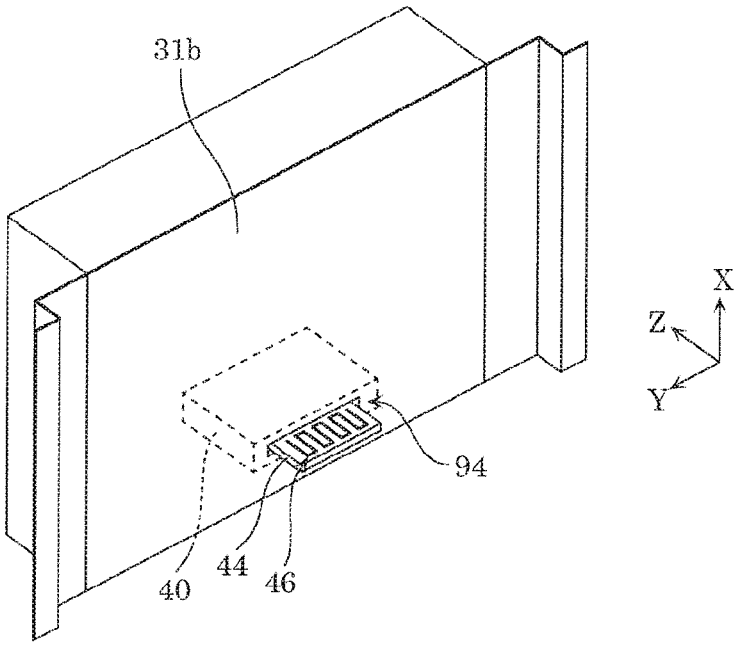
FIG. 8B is an external view of the light driving apparatus for describing measurement condition 4.

Under measurement condition 4, as the opening provided in the housing of the light driving apparatus, only opening 94 through which just antenna 46 formed on substrate 44 in wireless communication module 40 can pass is provided in bottom face 31*b* of the housing, as illustrated in FIG. 8B. Then, under measurement condition 4, antenna 46 of wireless communication module 40 is exposed to the outside through opening 94 provided in bottom face 31*b* of the housing.

(5) Measurement Condition 5 (A Opening in Lateral Face in XZ Plane is Only Opening)

Figure 8C:
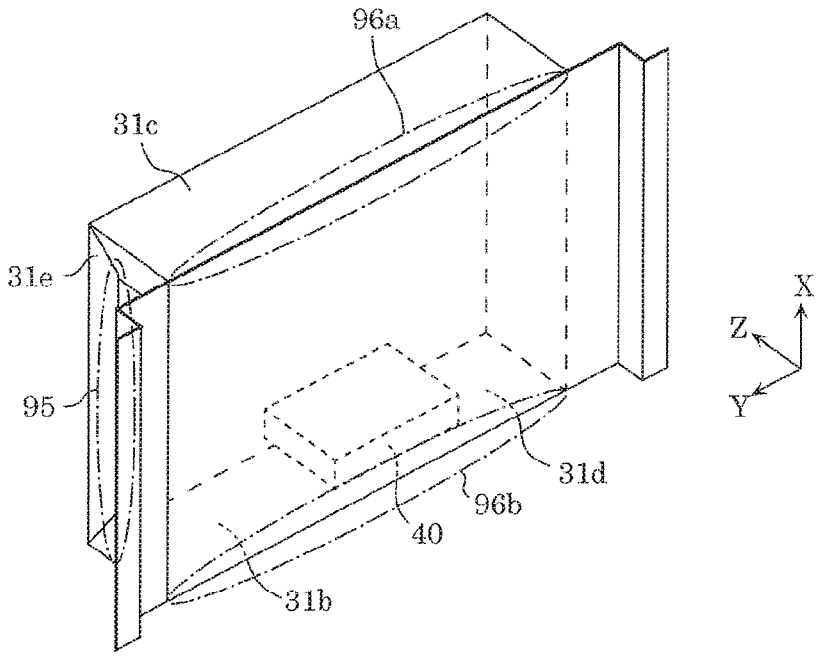
FIG. 8C is an external view of the light driving apparatus for describing measurement conditions 5 and 6.

Under measurement condition 5, as the opening provided in the housing of the light driving apparatus, only A opening 95 formed in the lateral face (lateral face 31*e*) in the XZ plane is provided, as illustrated in FIG. 8C. A opening 95 is a gap in lateral face 31*e* formed by bending edge portions of top face 31*a* and lateral faces 31*c* and 31*d* of the housing, for example.

(6) Measurement Condition 6 (B Openings at Boundaries Between Bottom Face and Lateral Faces in YZ Faces are Only Openings)

Under measurement condition 6, only B openings 96*a* and 96*b* formed at the boundaries between bottom face 31*b* and the lateral faces in the YZ planes (lateral faces 31*c* and 31*d*) are provided as the openings which are provided in the housing of the light driving apparatus, as illustrated in FIG. 8C. B openings 96*a* and 96*b* are gaps formed in the portions where cover housing 32 and bottom housing 33 are disposed one on top of the other, for example (see FIG. 3).

Figure 9:
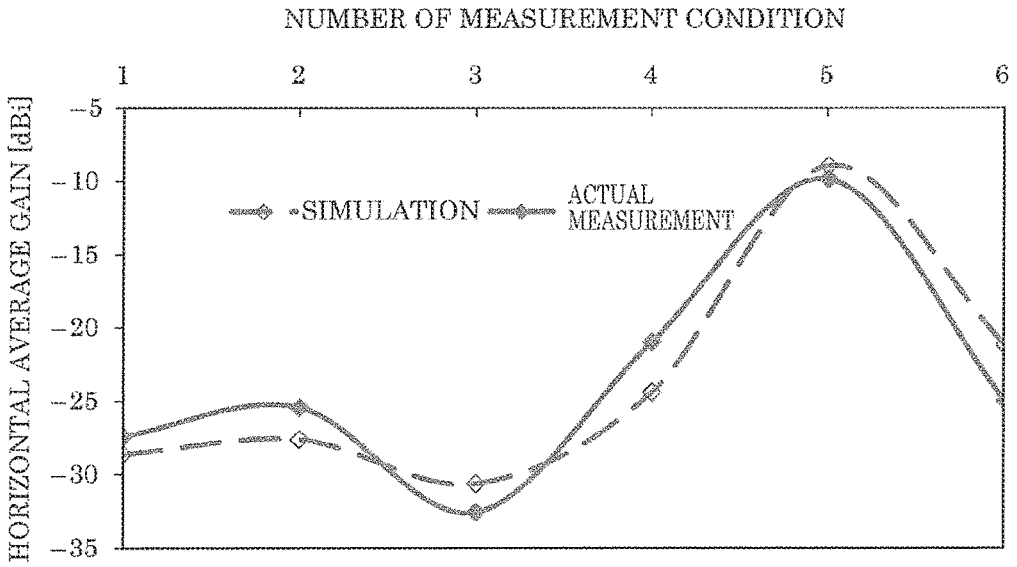
FIG. 9 is a diagram illustrating results of simulations and actual measurement of gains in emission of electromagnetic waves under six measurement conditions.

FIG. 9 is a diagram illustrating the results of simulations (indicated by the dashed line) and the results of actual measurements (indicated by the solid line), with respect to gains in emission of electromagnetic waves under the six measurement conditions described above (here, horizontal average gains (dBi) with respect to the perfect nondirection antenna). The horizontal axis indicates the number of measurement conditions 1 to 6 described above, and the vertical axis indicates the horizontal average gain (dBi).

The simulations and actual measurements show almost the same trend. As is clear from FIG. 9, the results obtained under measurement conditions 2 and 3 are substantially the same as the result obtained under measurement condition 1 under which all the gaps in the housing are sealed, and show low gains. This shows that, as described in the above embodiment and the variation, it is better to form slits in faces of the housing which are opposed to substrate 44 on which the wiring pattern of antenna 46 is formed.

As illustrated in FIG. 9, the results obtained under measurement condition 4 shows higher gains than those obtained under measurement condition 1 under which antenna 46 is housed in housing 31, but lower than the gain (−8 dBi) in the above embodiment illustrated in FIG. 5B and the gain (−9 dBi) in the variation illustrated in FIG. 7. This shows that electromagnetic waves are emitted at a higher gain than the case where antenna 46 is exposed from housing 31, by housing antenna 46 in housing 31 similarly to the light driving apparatuses according to the above embodiment and the variation.

As illustrated in FIG. 9, the gains obtained under measurement condition 5 are the highest of the gains obtained under six measurement conditions 1 to 6, yet slightly lower than the gain (−8 dBi) in the above embodiment illustrated in FIG. 5B and the gain in the variation illustrated in FIG. 7 (−9 dBi). This shows that it is better to form slits in faces of the housing (top face 31*a* and bottom face 31*b* in the embodiment, and lateral faces 31*c* and 31*d* in the variation) which are opposed to substrate 44 on which a wiring pattern of antenna 46 is formed, similarly to the embodiment and the variation described above. However, even if slits are formed in the lateral faces (lateral faces 31*e* and 31*f*) along the lengthwise edges of housing 31 (along the Y axis) similarly to measurement condition 5, electromagnetic waves are emitted at gains satisfactory to a certain extent.

As illustrated in FIG. 9, the gains under measurement condition 6 are lower than those under measurement condition 5. This shows that B openings 96*a* and 96*b* like gaps formed in portions where cover housing 32 and bottom housing 33 are disposed one on top of the other do not fully function as slit antennas.

As described above, reference data illustrated in FIG. 9 shows that the gain of the antenna is sufficiently maintained by maintaining the positional relation between the wireless communication module and slits provided in the housing of the light driving apparatus to be the relation as those in the light driving apparatuses according to the above embodiment and the above variation. Specifically, it is better to form slits 90*a* and 90*b* in two opposite faces of housing 31, extending in a direction three-dimensionally crossing the directions 46*a* and 46*b* in which wireless communication module 40 excites antenna 46. Furthermore, the two faces would rather be opposed to substrate 44 on which a wiring pattern serving as antenna 46 is formed.

This completes the description of the lighting device and the light driving apparatus according to the present disclosure, based on the embodiment and the variation, yet the present disclosure is not limited to the lighting device and the light driving apparatus. The present disclosure may be achieved as a light control system which includes control apparatus 4 and lighting device 10 or light driving apparatus 30 illustrated in FIG. 1.

Figure 10:
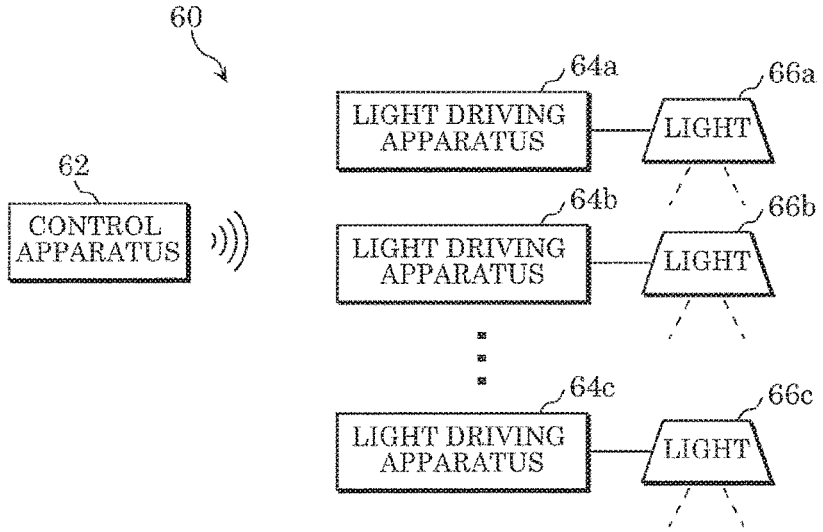
FIG. 10 is a block diagram illustrating a configuration of a light control system according to the embodiment.

FIG. 10 is a block diagram illustrating a configuration of light control system 60 according to the embodiment of the present disclosure.

Light control system 60 includes a plurality of light driving apparatuses 64*a* to 64*c*, and one control apparatus 62 which wirelessly transmits indications to light driving apparatuses 64*a* to 64*c*. Note that FIG. 10 also illustrates lights 66*a* to 66*c* which emit light using power from light driving apparatuses 64*a* to 64*c*.

Light driving apparatuses 64*a* to 64*c* correspond to light driving apparatus 30 according to the embodiment or light driving apparatus 30*a* according to the above variation. Control apparatus 62 may be an apparatus corresponding to control apparatus 4 in FIG. 1, or may be an apparatus which relays indications from control apparatus 4 in FIG. 1, and wirelessly transmits the indications to light driving apparatuses 64*a* to 64*c*.

In such light control system 60, light driving apparatuses 64*a* to 64*c* are controlled, and dimming and color adjustment, for instance, of lights 66*a* to 66*c* are controlled, based on indications transmitted through wireless communication from one control apparatus 62.

Note that light control system 60 includes light driving apparatuses 64*a* to 64*c*, and one control apparatus (32 in FIG. 10, yet light control system 60 may include lights 66*a* to 66*c* which emit light using power from light driving apparatuses 64*a* to 64*c*, in addition to light driving apparatuses 64*a* to 64*c* and one control apparatus 62. Thus, the light control system may include lighting devices and a control apparatus which controls the lighting devices.

Although this completes the description of the light driving apparatus and the light control system according to the present disclosure, based on the embodiment and the variation, the present disclosure is not limited to the embodiment and the variation described above. The present disclosure also encompasses other embodiments obtained by applying various changes that may be conceived by a person skilled in the art to the embodiment and the variation and by combining the elements in the embodiment and the variation without departing from the scope of the present disclosure.

For example, the light driving apparatus according the embodiment and the variation described above is used for lighting device 10 as a downlight, yet use of the light driving apparatus is not limited to a downlight and the light driving apparatus may be applied to a ceiling light, a pendant light, a desk lamp, and a spotlight, for instance.

In the embodiment and the variation described above, light source 21 includes LEDs, yet other types of light sources such as an organic electroluminescent (EL) display may be adopted.

In the embodiment and the variation described above, the light driving apparatus includes a housing whose shape is a rectangular parallelepiped. Yet, the shape of the housing is not limited to this, and may be a cube, a cone, a cylinder, or a combination of such shapes.

In addition, in the embodiment and the variation described above, the lighting device to which the light driving apparatus is applied has a structure in which the light driving apparatus and a light are connected by a cable. Yet, the structure is not limited to such a structure, and the lighting device may be a lighting device in which the light driving apparatus and a light source are housed in a single housing.

In the embodiment and the variation described above, in the light driving apparatus, slits are formed in only a pair of opposite faces of the housing, yet slits may be formed in three or more portions. For example, housing 31 may include slits 90*a* and 90*b* formed in top face 31*a* and bottom face 31*b* in the above embodiment, and slits 91*a* and 91*b* formed in lateral faces 31*c* anti 31*d* in the above variation.

In the embodiment and the variation described above, the slits formed in the housing extend lengthwise of the elongated face of the housing, yet the slits may extend in any directions as long as the direction three-dimensionally crosses the direction in which an antenna is excited.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A light driving apparatus that supplies power to a light source in accordance with an indication from a control apparatus, the light driving apparatus comprising:

a housing, which is box-shaped;

a wireless communication module, which is housed in the housing, and includes an antenna for wireless communication with the control apparatus; and a light driver, which is housed in the housing, and supplies power to the light source in accordance with the indication received from the control apparatus via the wireless communication module, wherein the housing includes two opposite faces having slits through which an electromagnetic wave that the antenna emits when excited by the wireless communication module passes, the slits extending in a direction three-dimensionally crossing an excitation direction in which the wireless communication module excites the antenna, the slits are extending lengthwise of the two opposite faces, the two opposite faces are a top face and a bottom face of the housing, the wireless communication module and the light driver are disposed widthwise, side by side on the bottom face inside the housing, and when viewed perpendicularly to the top face and the bottom face, the slits are extending in the top face and the bottom face, on a side where the wireless communication module is disposed relative to a center line that halves a width of the top face and a width of the bottom face.

2. The light driving apparatus according to claim 1, wherein the wireless communication module includes a substrate, the antenna includes a wiring pattern formed on the substrate, and the two opposite faces are opposed to the substrate.

3. The light driving apparatus according to claim 1, wherein the two opposite faces each have an elongated shape.

4. The light driving apparatus according to claim 1, wherein the slits in the two opposite faces overlap the wireless communication module when viewed perpendicularly to the two opposite faces.

5. The light driving apparatus according to claim 1, wherein the slits in the two opposite faces appear to overlap one another when viewed perpendicularly to the two opposite faces.

6. The light driving apparatus according to claim 1, wherein the slits in the two opposite faces are openings each defined by a closed contour.

7. A light control system, comprising:

a plurality of light driving apparatuses each being the light driving apparatus according to claim 1; and the control apparatus in claim 1 that wirelessly transmits indications to the plurality of light driving apparatuses.

* * * * *